US009133010B2

(12) United States Patent
Huang

(10) Patent No.: US 9,133,010 B2
(45) Date of Patent: Sep. 15, 2015

(54) BEVERAGE SERVER WITH CONVENIENTLY SEPARABLE BARREL BODY AND BASE

(71) Applicant: GUANGZHOU HEKOUMEI HOUSEWARE DEVELOPMENT CO. LTD., Guangzhou (CN)

(72) Inventor: Wei Huang, Guangzhou (CN)

( * ) Notice: Subject to any disclaimer, the term of this patent is extended or adjusted under 35 U.S.C. 154(b) by 79 days.

(21) Appl. No.: 14/050,385

(22) Filed: Oct. 10, 2013

(65) Prior Publication Data

US 2015/0102066 A1 Apr. 16, 2015

(51) Int. Cl.

| | |
|---|---|
| ***B67D 7/06*** | (2010.01) |
| ***B67D 3/00*** | (2006.01) |
| ***B67D 3/04*** | (2006.01) |

(52) U.S. Cl.

CPC ..... *B67D 3/0083* (2013.01); *B67D 3/00* (2013.01); *B67D 3/0029* (2013.01); *B67D 3/04* (2013.01)

(58) Field of Classification Search

CPC ..... B67D 3/04; B67D 3/00; B67D 3/0029
USPC ..... 222/185.1, 181.1, 184, 108, 222/129.1–129.4

See application file for complete search history.

(56) References Cited

U.S. PATENT DOCUMENTS

| | | | | |
|---|---|---|---|---|
| 5,827,428 | A * | 10/1998 | Chang | 210/248 |
| 6,189,720 | B1 * | 2/2001 | Gillispie | 220/571 |
| 6,619,507 | B2 * | 9/2003 | Lassota | 222/108 |
| 6,820,771 | B2 * | 11/2004 | Lassota et al. | 222/185.1 |
| 7,926,413 | B2 * | 4/2011 | Hart | 99/279 |
| 2008/0156827 | A1 * | 7/2008 | Alberto Rodrigues Anjos | 222/105 |

* cited by examiner

*Primary Examiner* — Frederick C Nicolas

(74) *Attorney, Agent, or Firm* — Prakash Nama; Global IP Services, PLLC

(57) ABSTRACT

A beverage server with conveniently separable barrel body and base has a barrel body, a base, an upper connecting plate disposed at a bottom surface of the barrel body, and a lower connecting plate disposed at an upper surface of the base. The lower connecting plate and the upper connecting plate are removably connected with each other via a rotary clamping unit. The present invention has a simple structure, and its barrel body and base can be separated without the need of using external assisting tools, and its rotary clamping unit is not easy to fall off and lost, and its rotary clamping unit will not wobble after the barrel body and the base are separated.

7 Claims, 9 Drawing Sheets

BEVERAGE SERVER WITH CONVENIENTLY SEPARABLE BARREL BODY AND BASE

BACKGROUND OF THE INVENTION

The present invention relates to a beverage server having a barrel body and a base conveniently separable from each other. Nowadays, a barrel body and a base of a beverage server are usually connected by means of welding connection, rivet connection and screw thread connection etc. Barrel body and base connected by means of these kinds of connection are relatively difficult to be disconnected from each other, and thus bringing much inconvenience to users. Therefore, it is an objective of the relevant industry to provide a beverage server having parts which can be separated easily and conveniently.

BRIEF SUMMARY OF THE INVENTION

In view of the aforesaid disadvantage now present in the prior art, the present invention provides a beverage server with conveniently separable barrel body and base according to which the beverage server has a simple structure, parts of the beverage server can be separated without the need of using external assisting tools, and a rotary clamping unit on the beverage server is not easy to fall off and lost.

Another object of the present invention is to provide a beverage server with conveniently separable barrel body and base according to which the rotary clamping unit will not wobble after the barrel body and the base are separated.

A beverage server with conveniently separable barrel body and base according to the present invention comprises a barrel body, a base, an upper connecting plate disposed at a bottom surface of the barrel body, a lower connecting plate disposed at an upper surface of the base; the lower connecting plate and the upper connecting plate are removably connected with each other via a rotary clamping unit; the rotary clamping unit comprises a rotary knob, an elongated press bar and a rotational axis connecting the rotary knob and the elongated press bar; the upper connecting plate and the lower connecting plate are each provided with an elongated through hole for the elongated press bar to pass through; the rotational axis is provided with an upper grip ring and a lower grip ring; in between the upper grip ring and the lower grip ring, there is a gripping groove; the elongated through hole of the upper connecting plate and the elongated through hole of the lower connecting plate are not wider than an outer diameter of the upper grip ring and an outer diameter of the lower grip ring respectively; two sides of the elongated through hole of the lower connecting plate are rotably gripped in the gripping groove; after the elongated press bar passes through the elongated through hole of the upper connecting plate, the rotary knob is turned by a certain degree to enable the elongated press bar to press tightly against and coordinate with an upper surface of the upper connecting plate.

The present invention also has the following additional features:

Two press platforms are disposed on the upper surface of the upper connecting plate and they are symmetrically and respectively arranged next to two opposite sides of the elongated through hole of the upper connecting plate; two vertical blocking panels are provided respectively at rear ends of the two press platforms along a path according to which the elongated press bar follows when the elongated press bar is turned and tightened on the upper surface of the upper connecting plate; two position limiting ribs are provided respectively at front ends of the two press platforms; two arc-shaped slopes are provided respectively at front sides of the two position limiting ribs; a distance between top surfaces of the two press platforms and a top surface of the lower grip ring is slightly longer than a distance between a bottom surface of the elongated press bar and the top surface of the lower grip ring.

When viewing the beverage server from top to bottom, a joined centerline of centerlines of the two press platforms is perpendicular to a centerline of the elongated through hole of the upper connecting plate.

Two short press panels are provided symmetrically and respectively at two sides of the upper grip ring; when viewing the beverage server from top to bottom, a joined centerline of centerlines of the two short press panels is perpendicular to a centerline of the elongated press bar; two second press platforms are disposed on the lower connecting plate and are symmetrically and respectively arranged next to two opposite sides of the elongated through hole of the lower connecting plate; two vertical second blocking panels are provided respectively at rear ends of the two second press platforms along a path opposite to the path according to which the elongated press bar follows when the elongated press bar is turned and tightened; two second position limiting ribs are provided respectively at front ends of the two second press platforms; two second arc-shaped slopes are provided respectively at front sides of the two second position limiting ribs; a distance between top surfaces of the two second press platforms and the top surface of the lower grip ring is slightly longer than a distance between bottom surfaces of the short press panels and the top surface of the lower grip ring; when viewing the beverage server from top to bottom, a joined centerline of centerlines of the two second press platforms is perpendicular to a centerline of the elongated through hole of the lower connecting plate.

The outer diameter of the upper grip ring is smaller than the outer diameter of the lower grip ring; the upper grip ring has a conical shape with its top side narrower than its bottom side.

Plurality of positioning blocks are provided at periphery of a bottom surface of the upper connecting plate; plurality of positioning recesses corresponding to the positioning blocks are provided at periphery of an upper surface of the lower connecting plate.

Plurality of second positioning blocks are provided at periphery of a bottom surface of the lower connecting plate; plurality of second positioning recesses corresponding to the second positioning blocks are provided at periphery of the upper surface of the base.

As compared with existing prior arts, the beverage server with conveniently separable barrel body and base according to the present invention is advantageous in that, it has a simple structure, and its barrel body and base can be separated without the need of using external assisting tools, and its rotary clamping unit is not easy to fall off and lost, and its rotary clamping unit will not wobble after the barrel body and the base are separated.

BRIEF DESCRIPTION OF THE DRAWINGS

The present invention is now described in detail below with reference to an embodiment and the accompanying drawings.

DETAILED DESCRIPTION OF THE INVENTION

Figure 1:
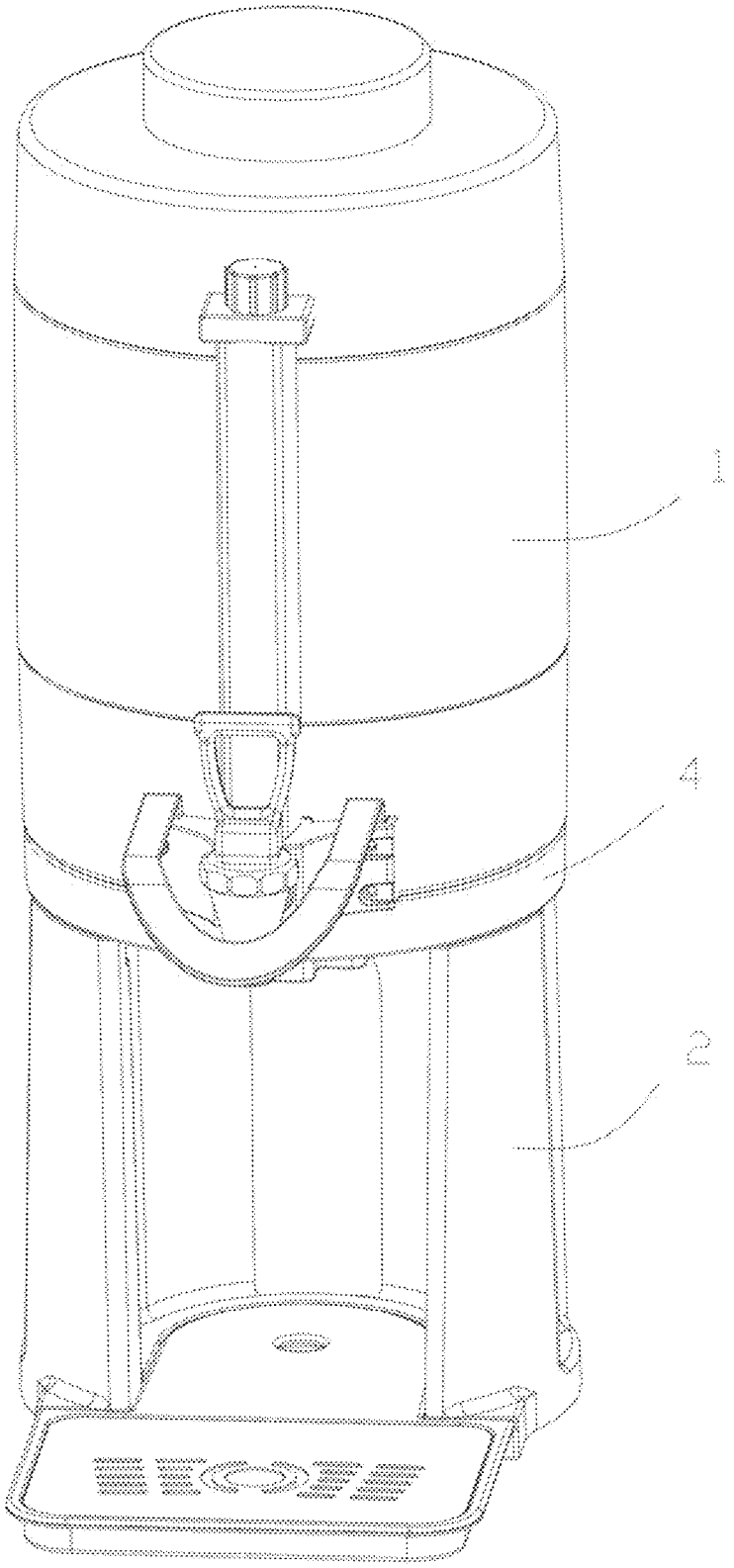
FIG. 1 illustrates an overall structure of the present invention.
Figure 2:
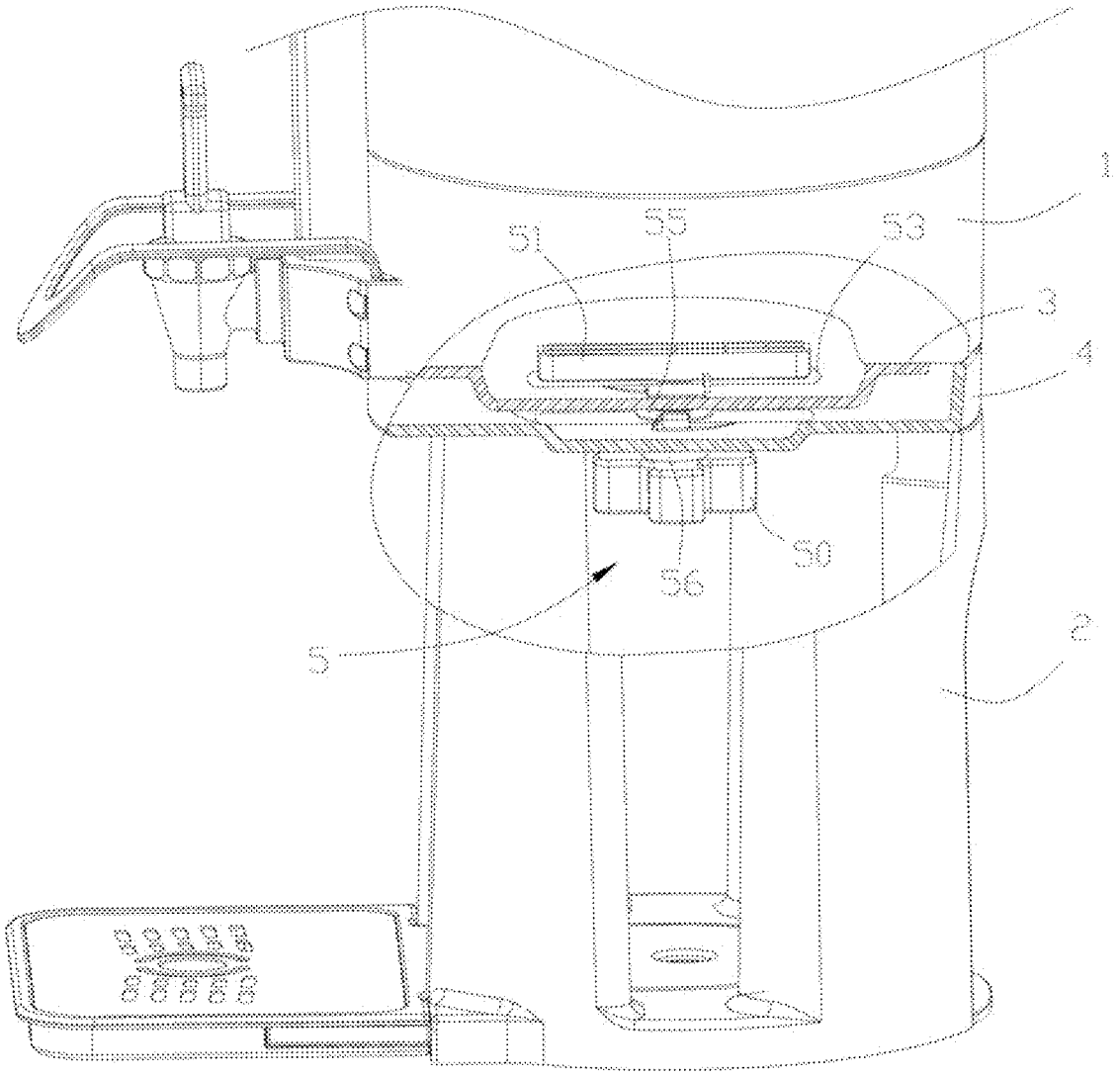
FIG. 2 shows a structure of the present invention in a partial sectional view illustrating a condition in which the barrel body and the base are not locked tightly.
Figure 3:
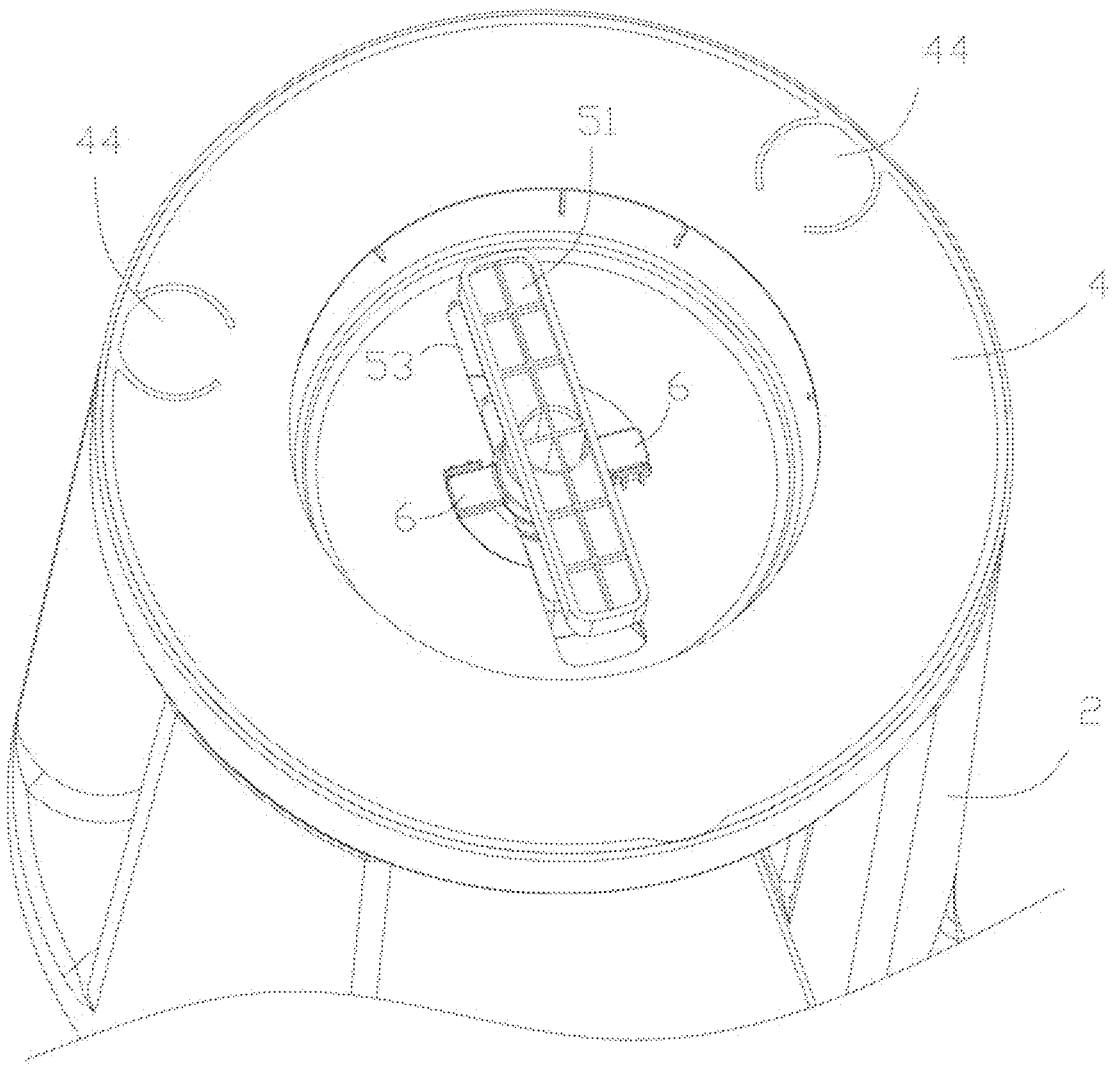
FIG. 3 illustrates a condition in which the short press panels and the lower connecting plate are locked tightly.
Figure 4:
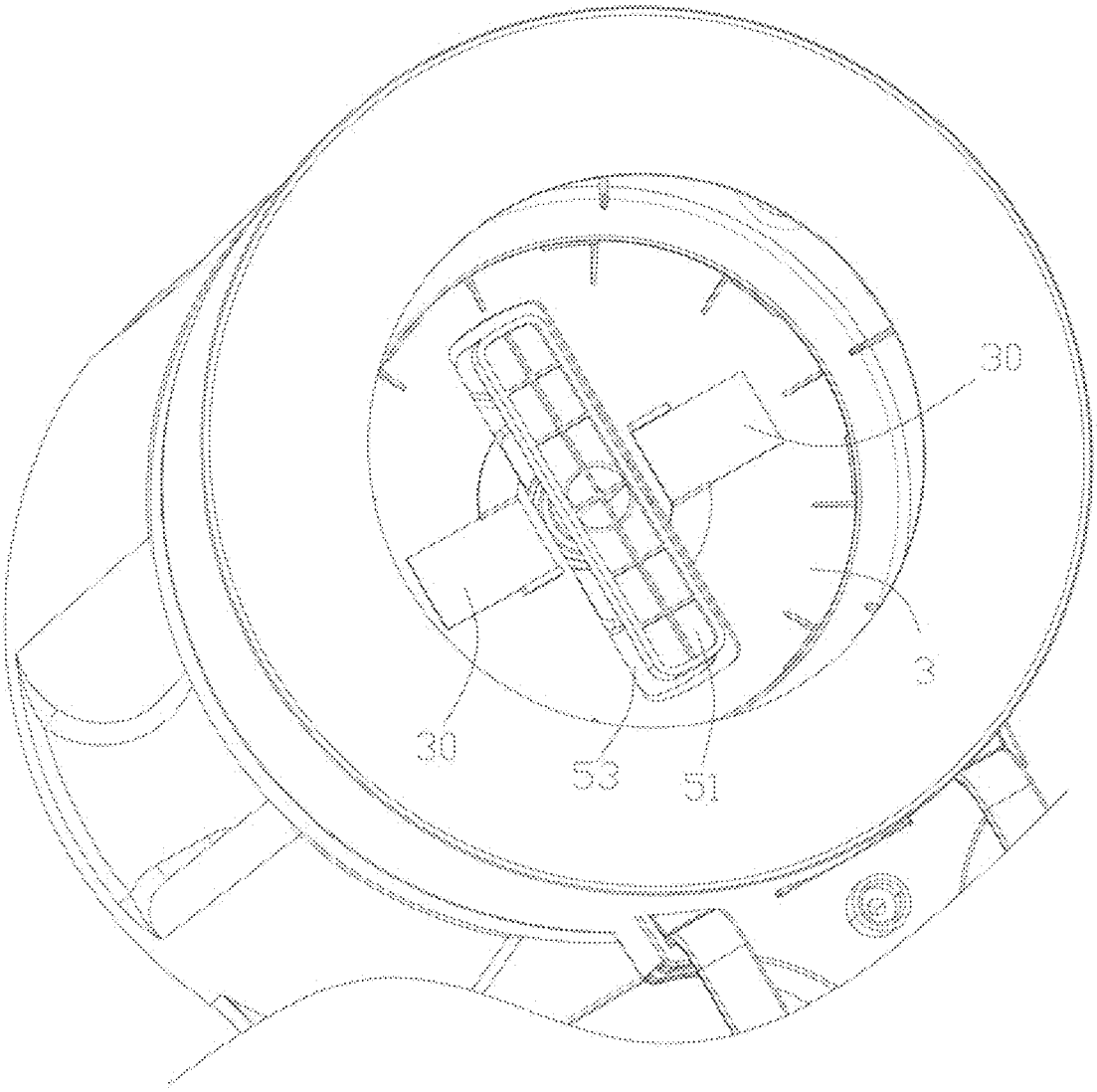
FIG. 4 illustrates the elongated press bar 51 in its initial condition.
Figure 5:
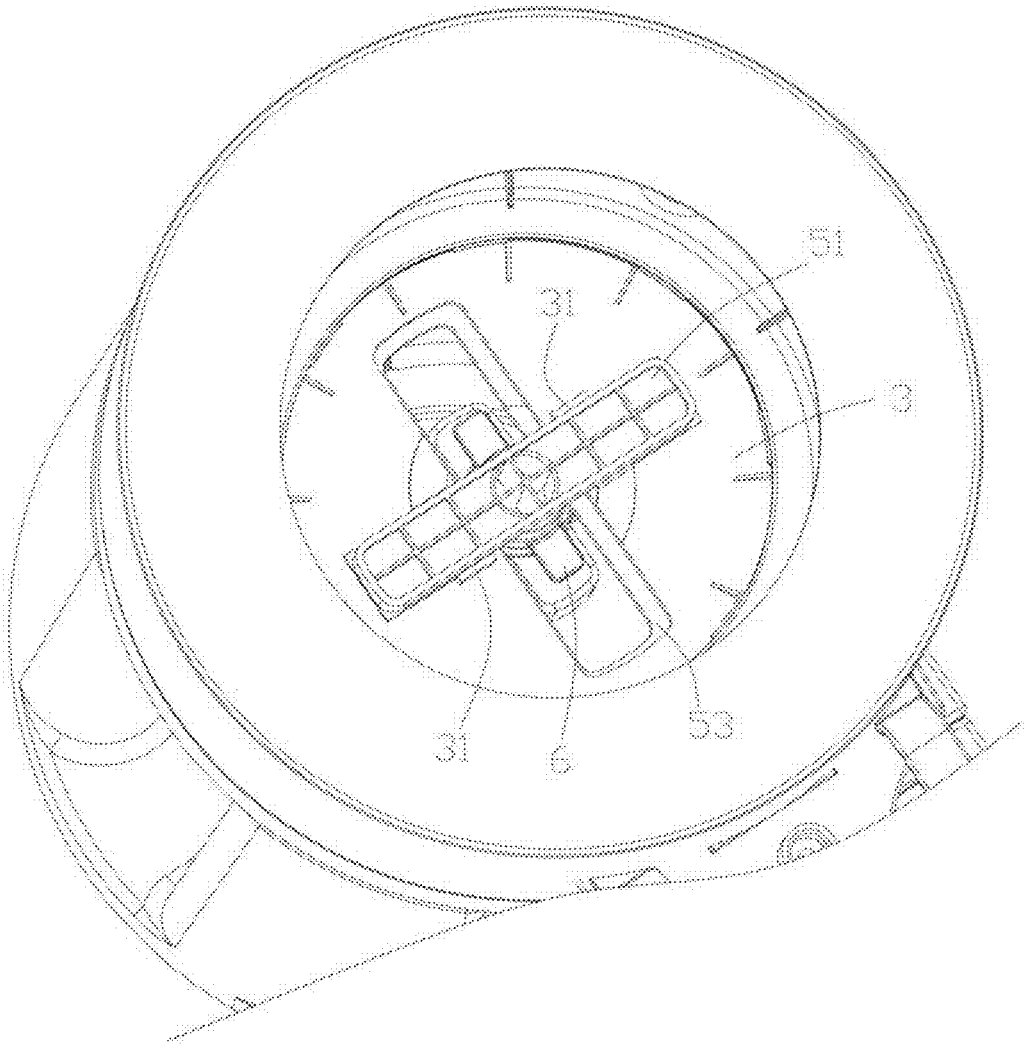
FIG. 5 illustrates the elongated press bar 51 in a locked condition.
Figure 6:
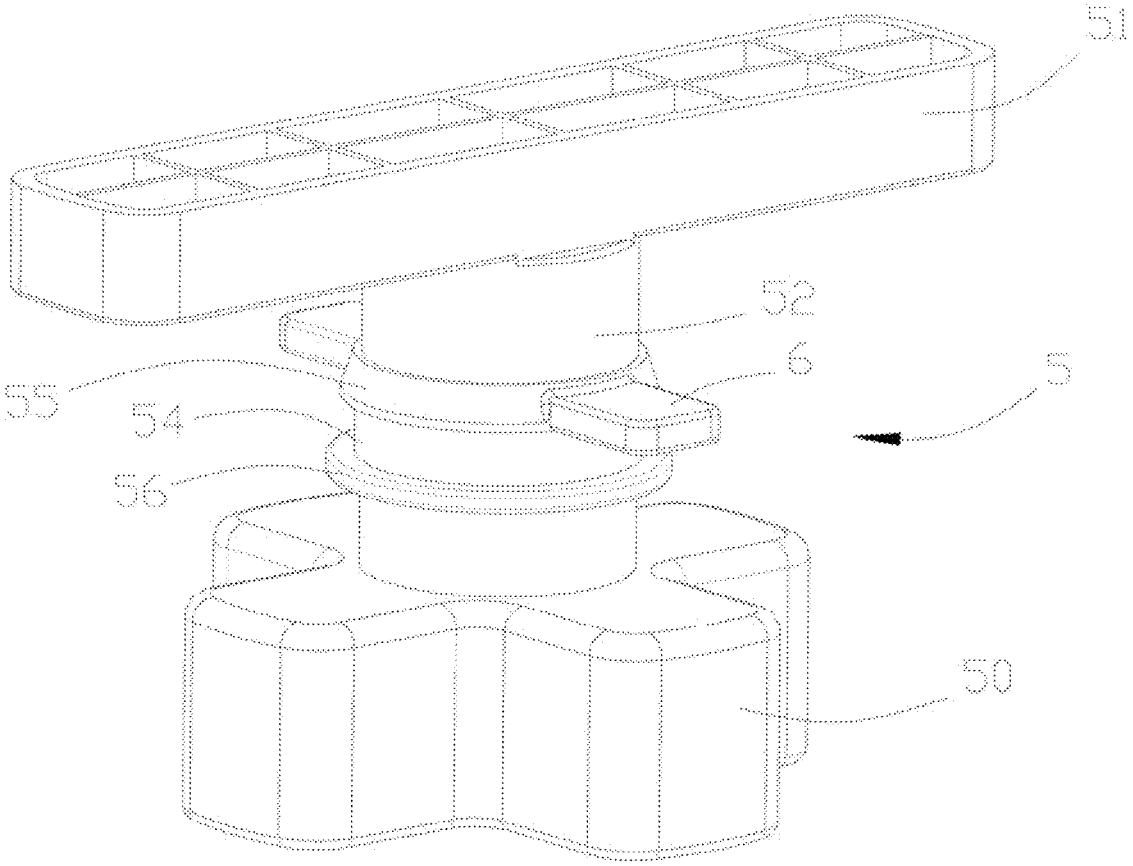
FIG. 6 is a perspective view of the rotary clamping unit.
Figure 7:
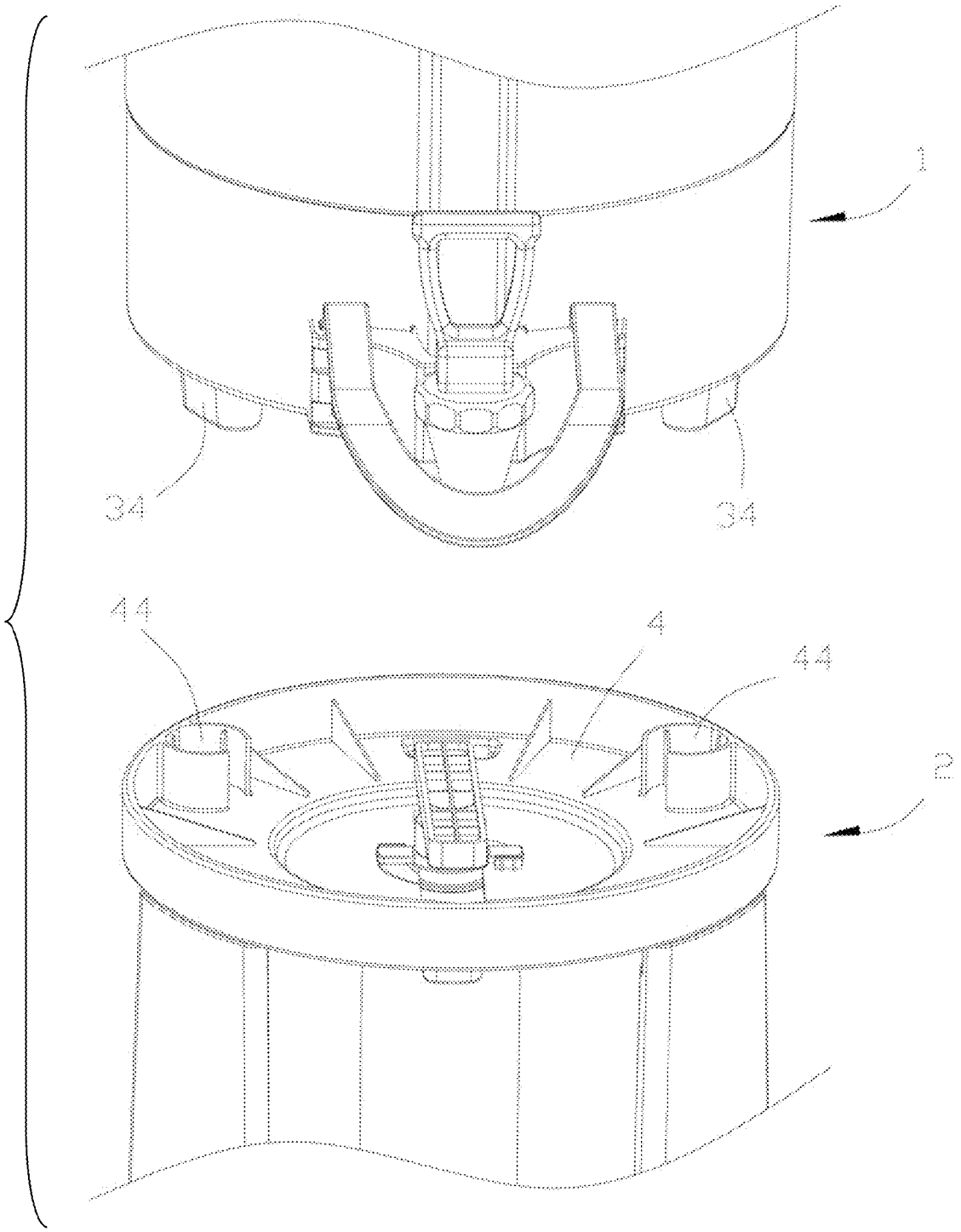
FIG. 7 illustrates a condition in which the barrel body and the base are separated.
Figure 8:
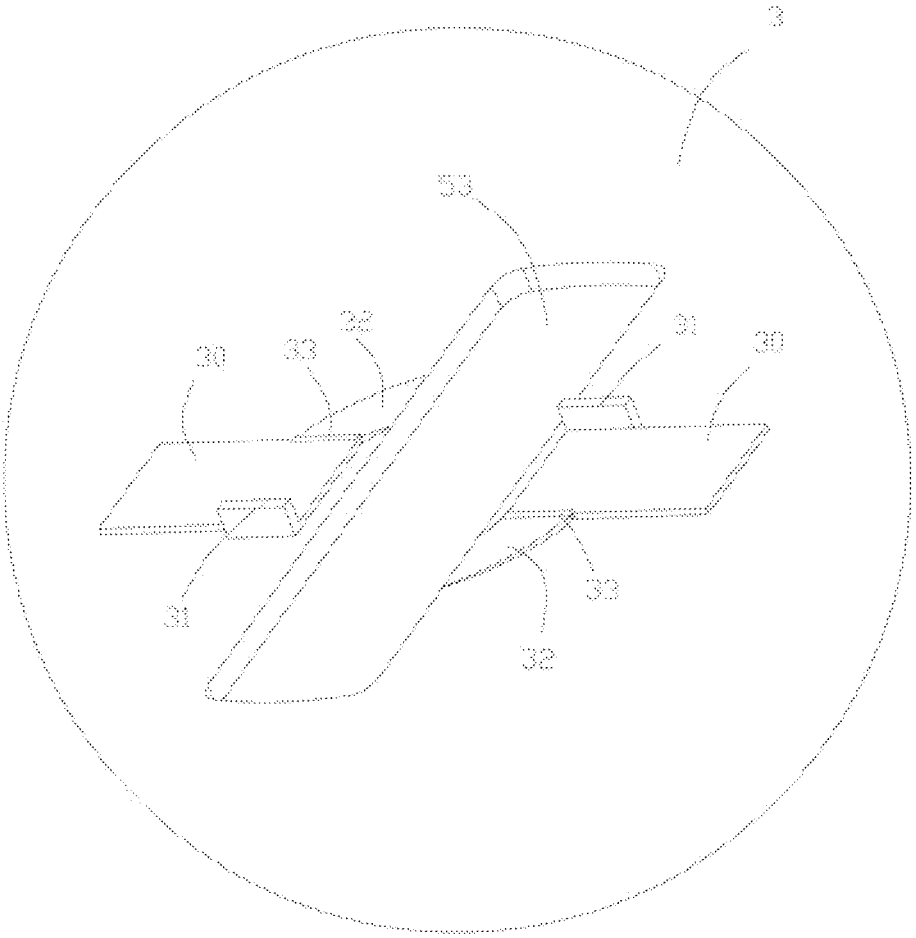
FIG. 8 is a structural view illustrating the elongated through hole on the upper connecting plate and the press platforms.
Figure 9:
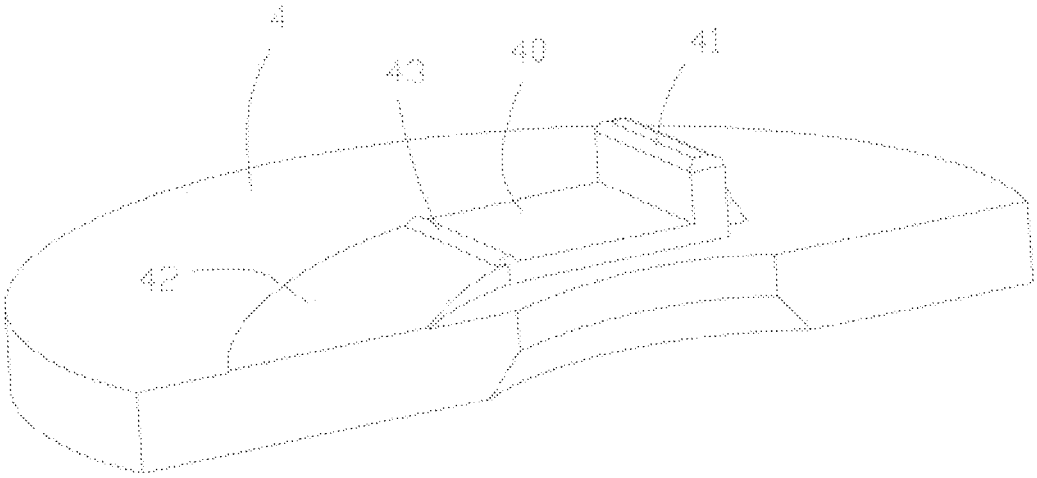
FIG. 9 is a structural view illustrating one of the second press platforms on the lower connecting plate.
Figure 10:
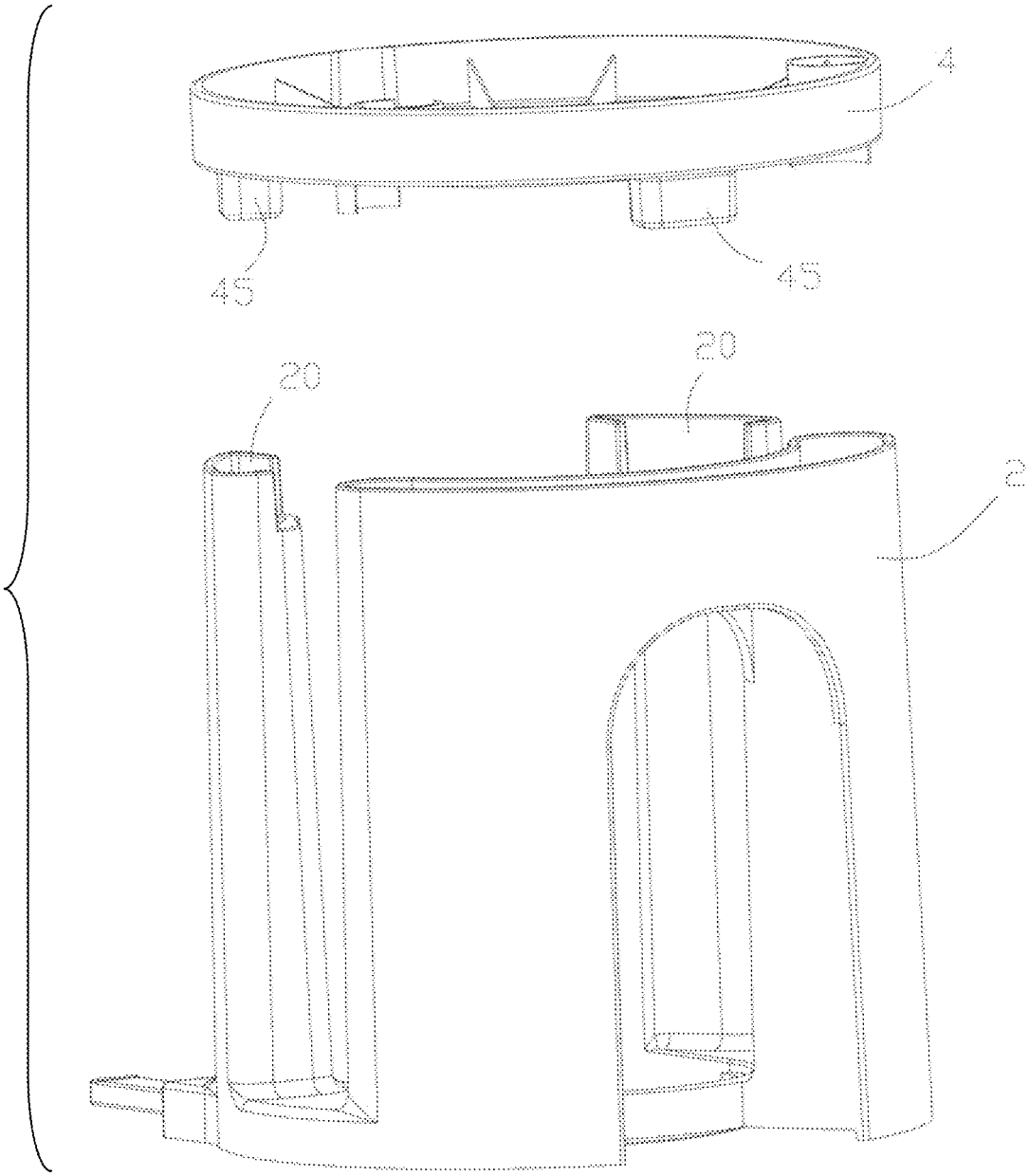
FIG. 10 is a structural view illustrating the lower connecting plate and the base.

FIGS. 1-10 illustrate a preferred embodiment of the beverage server with conveniently separable barrel body and base according to the present invention. The beverage server with conveniently separable barrel body and base comprises a barrel body 1, a base 2, an upper connecting plate 3 disposed at a bottom surface of the barrel body 1, a lower connecting plate 4 disposed at an upper surface of the base 2. The lower connecting plate 4 and the upper connecting plate 3 are removably connected with each other via a rotary clamping unit 5. The rotary clamping unit 5 comprises a rotary knob 50, an elongated press bar 51 and a rotational axis 52 connecting the rotary knob 50 and the elongated press bar 51. The upper connecting plate 3 and the lower connecting plate 4 are each provided with an elongated through hole 53 for the elongated press bar 51 to pass through. The rotational axis 52 is provided with an upper grip ring 55 and a lower grip ring 56. In between the upper grip ring 55 and the lower grip ring 56, there is a gripping groove 54. The elongated through hole 53 of the upper connecting plate 3 and the elongated through hole 53 of the lower connecting plate 4 are not wider than an outer diameter of the upper grip ring 55 and an outer diameter of the lower grip ring 56 respectively. Two sides of the elongated through hole 53 of the lower connecting plate 4 are rotably gripped in the gripping groove 54 so that the rotary clamping unit 5 will not fall off, and thus effectively preventing losing the rotary clamping unit 5. After the elongated press bar 51 passes through the elongated through hole 53 of the upper connecting plate 3, the rotary knob 50 is turned by a certain degree to enable the elongated press bar 51 to press tightly against and coordinate with an upper surface of the upper connecting plate 3. In the present embodiment, the rotary knob 50 is turned by 90 degrees to enable the elongated press bar 51 to press tightly against and coordinate with the upper surface of the upper connecting plate 3. The structure described above is very simple. Assembly and disassembly of the barrel body 1 and the base 2 can be achieved by turning the rotary knob 50 clockwise and anti-clockwise without the need of using external assisting tools.

In the present embodiment, two press platforms 30 are disposed on the upper surface of the upper connecting plate 3 and they are symmetrically and respectively arranged next to two opposite sides of the elongated through hole 53 of the upper connecting plate 3. Two vertical blocking panels 31 are provided respectively at rear ends of the two press platforms 30 along a path according to which the elongated press bar 51 follows when the elongated press bar 51 is turned and tightened on the upper surface of the upper connecting plate 3. The two blocking panels 31 are provided mainly to stop the elongated press bar 51 from being turned continuously. When two ends of the elongated press bar 51 press against the two blocking panels 31 respectively and the elongated press bar 51 is stopped from turning, mounting and tight locking of the barrel body 1 and the base 2 are accomplished. Two position limiting ribs 33 are provided respectively at front ends of the two press platforms 30. When the barrel body 1 and the base 2 are mounted and locked, each of the two ends of the elongated press bar 51 is constrained between a respective position limiting rib of the position limiting ribs 33 and a respective blocking panel of the blocking panels 31. Two arc-shaped slopes 32 are provided respectively at front sides of the two position limiting ribs 33 for gradual tightening and locking effect between the barrel body 1 and the base 2. A distance between top surfaces of the two press platforms 30 and a top surface of the lower grip ring 56 is slightly longer than a distance between a bottom surface of the elongated press bar 51 and the top surface of the lower grip ring 56 so as to ensure sufficient amount of clamping force between the elongated press bar 51 and the lower grip ring 56 when the barrel body 1 and the base 2 are tightly locked, thereby clamping the upper connecting plate 3 and the lower connecting plate 4 tightly between the top surface of the lower grip ring 56 and the bottom surface of the elongated press bar 51 and thus achieving strengthened connection between the upper connecting plate 3 and the lower connecting plate 4 and this strengthened connection is not easy to get loose. When viewing the beverage server from top to bottom, a joined centerline of centerlines of the two press platforms 30 is perpendicular to a centerline of the elongated through hole 53 of the upper connecting plate 3 so that when the elongated press bar 51 in its initial condition is being turned by 90 degrees, the upper connecting plate 3 and the lower connecting plate 4 is locked tightly ("Initial condition" of the elongated press bar 51 refers to the condition of the elongated press bar 51 right after it passes through the elongated through hole 53 of the upper connecting plate 3).

In the present embodiment, two short press panels 6 are provided symmetrically and respectively at two sides of the upper grip ring 55. When viewing the beverage server from top to bottom, a joined centerline of centerlines of the two short press panels 6 is perpendicular to a centerline of the elongated press bar 51. The two short press panels 6 are provided so that when the upper connecting plate 3 and the lower connecting plate 4 are disassembled and separated, the rotary clamping unit 5 can be firmly clamped on the lower connecting plate 4 and will not wobble. Two second press platforms 40 are disposed on the lower connecting plate 4 and are symmetrically and respectively arranged next to two opposite sides of the elongated through hole 53 of the lower connecting plate 4. Two vertical second blocking panels 41 are provided respectively at rear ends of the two second press platforms 40 along a path opposite to the path according to which the elongated press bar 51 follows when the elongated press bar 51 is turned and tightened. The two second blocking panels 41 are provided mainly to stop the two short press panels 6 from being turned continuously. When two ends of the respective two short press panels 6 press against the two second blocking panels 41 respectively and the two short press panels 6 are stopped from turning, clamping and tight locking of the rotary clamping unit 5 and the lower connecting plate 4 are accomplished. Two second position limiting ribs 43 are provided respectively at front ends of the two second press platforms 40. When the rotary clamping unit 5 and the lower connecting plate 4 are clamped together and locked, each of the two ends of the respective two short press panels 6 is constrained between a respective second position limiting rib of the second position limiting ribs 43 and a respective second blocking panel of the second blocking panels 41. Two second arc-shaped slopes 42 are provided respectively at front sides of the two second position limiting ribs 43 for gradual clamping and locking effect between the rotary clamping unit 5 and the lower connecting plate 4. A distance between top surfaces of the two second press platforms 30 and the top surface of the lower grip ring 56 is slightly longer than a distance between bottom surfaces of the short press panels 6 and the top surface of the lower grip ring 56 so as to ensure sufficient amount of clamping force between the short press panels 6 and the lower grip ring 56 when the rotary clamping unit 5 and the lower connecting plate 4 are clamped and tightly locked, thereby clamping the lower connecting plate 4 tightly between the top surface of the lower grip ring 56 and the bottom surfaces of the short press panels 6 and thus achieving strengthened connection between the rotary clamping unit 5 and the lower connecting plate 4 without any wobbling. When viewing the beverage server from top to bottom, a joined centerline of centerlines of the two second press platforms 40 is perpendicular to a centerline of the elongated through hole 53 of the lower connecting plate 4 so that when the elongated press bar 51 already turned by 90 degrees to achieve locking effect is turned reversely by 90 degrees back to its initial condition, the rotary clamping unit 5 and the lower connecting plate 4 is locked tightly.

In the present invention, the barrel body 1, the base 2, the upper connecting plate 3 and the lower connecting plate 4 are all made of plastic material. The outer diameter of the upper grip ring 55 is smaller than the outer diameter of the lower grip ring 56 so that the rotary clamping unit 5 can be easily fitted on the lower connecting plate 4. The upper grip ring 55 is provided mainly to prevent falling off of the rotary clamping unit 5 from the lower connecting plate 4. Therefore, the outer diameter of the upper grip ring 55 is only required to be slightly longer than width of the elongated through hole 53 of the lower connecting plate 4. When fitting the rotary clamping unit 5 on the lower connecting plate 4, the upper grip ring 55 is required to pass through the elongated through hole 53 of the lower connecting plate 4. According to the present invention, the upper grip ring 55 has a conical shape with its top side narrower than its bottom side so that it can easily pass through the elongated through hole 53 of the lower connecting plate 4.

In the present invention, plurality of positioning blocks 34 are provided at periphery of a bottom surface of the upper connecting plate 3. Plurality of positioning recesses 44 corresponding to the positioning blocks 34 are provided at periphery of an upper surface of the lower connecting plate 4. The positioning blocks 34 and the positioning recesses 44 are provided to align the elongated through hole 53 of the upper connecting plate and the elongated through hole of the lower connecting plate 4 so as to coordinate with clamping and tight locking between the upper connecting plate 3 and the lower connecting plate 4.

In the present invention, plurality of second positioning blocks 45 are provided at periphery of a bottom surface of the lower connecting plate 4. Plurality of second positioning recesses 20 corresponding to the second positioning blocks 45 are provided at periphery of the upper surface of the base 2. The second positioning blocks 45 and the second positioning recesses 20 are provided so that the lower connecting plate 4 and the base 2 can be easily fitted with each other.

To assemble the barrel body 1 and the base 2, lock the rotary clamping unit 5 and the lower connecting plate 4 together tightly, and then insert the positioning blocks 34 on the upper connecting plate 3 into the positioning recesses 44 on the lower connecting plate 4, and then the elongated press bar 51 will pass through the elongated through hole 53 of the upper connecting plate 3 and reach a position above the elongated through hole 53 of the upper connecting plate 3 (i.e. the elongated press bar 51 is in its initial condition), after that turn the rotary knob 50 towards a positive direction (positive direction is shown as anti-clockwise direction in the figures) by 90 degrees and the upper connecting plate 3 and the lower connecting plate 4 will be clamped and locked tightly. To separate the barrel body 1 and the base 2, turn the rotary knob 50 by 90 degrees at a direction opposite to the said positive direction. As shown above, the present invention has a simple structure enabling quick and convenient assembly and disassembly.

The above embodiment is only given to explain the present invention. The above embodiment does not limit the present invention. Any person skilled in this field of art can change and modify the present invention provided that the change and modification do not deviate from the spirit and scope of the present invention. All other equivalent technical proposals should therefore fall within the scope of the present invention. The scope of protection of the present invention is limited by the Claims.

What is claimed is:

1. A beverage server with conveniently separable barrel body and base comprises a barrel body (1) and a base (2), characterized in that, an upper connecting plate (3) is disposed at a bottom surface of the barrel body (1); a lower connecting plate (4) is disposed at an upper surface of the base (2); the lower connecting plate (4) and the upper connecting plate (3) are removably connected with each other via a rotary clamping unit (5); the rotary clamping unit (5) comprises a rotary knob (50), an elongated press bar (51) and a rotational axis (52) connecting the rotary knob (50) and the elongated press bar (51); the upper connecting plate (3) and the lower connecting plate (4) are each provided with an elongated through hole (53) for the elongated press bar (51) to pass through; the rotational axis (52) is provided with an upper grip ring (55) and a lower grip ring (56); in between the upper grip ring (55) and the lower grip ring (56), there is a gripping groove (54); the elongated through hole (53) of the upper connecting plate (3) and the elongated through hole (53) of the lower connecting plate (4) are not wider than an outer diameter of the upper grip ring (55) and an outer diameter of the lower grip ring (56) respectively; two sides of the elongated through hole (53) of the lower connecting plate (4) are rotatably gripped in the gripping groove (54); after the elongated press bar (51) passes through the elongated through hole (53) of the upper connecting plate (3), the rotary knob (50) is turned by a certain degree to enable the elongated press bar (51) to press tightly against and coordinate with an upper surface of the upper connecting plate (3).

2. The beverage server with conveniently separable barrel body and base as in claim 1, wherein two press platforms (30) are disposed on the upper surface of the upper connecting plate (3) and the two press platforms (30) are symmetrically and respectively arranged next to two opposite sides of the elongated through hole (53) of the upper connecting plate (3); two vertical blocking panels (31) are provided respectively at rear ends of the two press platforms (30) along a path according to which the elongated press bar (51) follows when the elongated press bar (51) is turned and tightened on the upper surface of the upper connecting plate (3); two position limiting ribs (33) are provided respectively at front ends of the two press platforms (30); two arc-shaped slopes (32) are provided respectively at front sides of the two position limiting ribs (33); a distance between top surfaces of the two press platforms (30) and a top surface of the lower grip ring (56) is slightly longer than a distance between a bottom surface of the elongated press bar (51) and the top surface of the lower grip ring (56).

3. The beverage server with conveniently separable barrel body and base as in claim 2, wherein when viewing the beverage server from top to bottom, a joined centerline of centerlines of the two press platforms (30) is perpendicular to a centerline of the elongated through hole (53) of the upper connecting plate (3).

4. The beverage server with conveniently separable barrel body and base as in claim 3, wherein two short press panels (6) are provided symmetrically and respectively at two sides of the upper grip ring (55); when viewing the beverage server from top to bottom, a joined centerline of centerlines of the two short press panels (6) is perpendicular to a centerline of the elongated press bar (51); two second press platforms (40) are disposed on the lower connecting plate (4) and are symmetrically and respectively arranged next to two opposite sides of the elongated through hole (53) of the lower connecting plate (4); two vertical second blocking panels (41) are provided respectively at rear ends of the two second press platforms (40) along a path opposite to the path according to which the elongated press bar (51) follows when the elongated press bar (51) is turned and tightened; two second position limiting ribs (43) are provided respectively at front ends of the two second press platforms (40); two second arc-shaped slopes (42) are provided respectively at front sides of the two second position limiting ribs (43); a distance between top surfaces of the two second press platforms (40) and the top surface of the lower grip ring (56) is slightly longer than a distance between bottom surfaces of the short press panels (6) and the top surface of the lower grip ring (56); when viewing the beverage server from top to bottom, a joined centerline of centerlines of the two second press platforms (40) is perpendicular to a centerline of the elongated through hole (53) of the lower connecting plate (4).

5. The beverage server with conveniently separable barrel body and base as in claim 1, wherein the outer diameter of the upper grip ring (55) is smaller than the outer diameter of the lower grip ring (56); the upper grip ring (55) has a conical shape with a top side of the upper grip ring (55) narrower than a bottom side of the upper grip ring (55).

6. The beverage server with conveniently separable barrel body and base as in claim 1, wherein plurality of positioning blocks (34) are provided at periphery of a bottom surface of the upper connecting plate (3); plurality of positioning recesses (44) corresponding to the positioning blocks (34) are provided at periphery of an upper surface of the lower connecting plate (4).

7. The beverage server with conveniently separable barrel body and base as in claim 1, wherein plurality of second positioning blocks (45) are provided at periphery of a bottom surface of the lower connecting plate (4); plurality of second positioning recesses (20) corresponding to the second positioning blocks (45) are provided at periphery of the upper surface of the base (2).

* * * * *